US009126701B2

(12) United States Patent
Sowislo et al.

(10) Patent No.: US 9,126,701 B2
(45) Date of Patent: Sep. 8, 2015

(54) METHOD OF OPERATING A BOTTLING PLANT

(75) Inventors: Peter Sowislo, Regensburg (DE); Wolfgang Hahn, Neutraubling (DE)

(73) Assignee: KRONES AG, Neutraubling (DE)

( * ) Notice: Subject to any disclaimer, the term of this patent is extended or adjusted under 35 U.S.C. 154(b) by 332 days.

(21) Appl. No.: 13/702,357

(22) PCT Filed: Jul. 6, 2011

(86) PCT No.: PCT/EP2011/003366
§ 371 (c)(1),
(2), (4) Date: Jan. 28, 2013

(87) PCT Pub. No.: WO2012/052076
PCT Pub. Date: Apr. 26, 2012

(65) Prior Publication Data

US 2013/0125509 A1 May 23, 2013

(30) Foreign Application Priority Data

Oct. 19, 2010 (DE) ..... 10 2010 042 624

(51) Int. Cl.
*B67C 3/00* (2006.01)
*B65B 3/00* (2006.01)
*B67C 3/28* (2006.01)

(52) U.S. Cl.
CPC . *B65B 3/00* (2013.01); *B67C 3/007* (2013.01); *B67C 3/287* (2013.01)

(58) Field of Classification Search
CPC ..... B67C 3/007; B67C 3/287; B65B 3/00
See application file for complete search history.

(56) References Cited

U.S. PATENT DOCUMENTS 4,275,439 A * 6/1981 Kuwata ..... 700/32
4,328,073 A * 5/1982 Likins, Jr. ..... 203/2
4,789,025 A * 12/1988 Brandemuehl et al. ..... 165/264
5,314,703 A * 5/1994 Gibney et al. ..... 426/231

(Continued)

FOREIGN PATENT DOCUMENTS

DE 1158856 12/1963
DE 2815980 A1 10/1979

(Continued)

OTHER PUBLICATIONS

Leslie D. Jensen, "Dynamic Alarm Management on an Ethylene Plant" Honeywell Users Group, Nice France 1995.*

(Continued)

*Primary Examiner* — Timothy H Hwang
(74) *Attorney, Agent, or Firm* — Marshall, Gerstein & Borun LLP

(57) ABSTRACT

A method of operating a bottling plant including at least one phase of running up the bottling plant and one phase of normal operation of the run-up bottling plant. By the actual value of at least one parameter characteristic of a proper operating state being measured, and in the phase of running up, a deviation of the actual value from a desired value of the parameter other than that in the phase of normal operation being admitted, an admissible deviation of the actual value from the desired value can be adapted to the comparably instable operational conditions during the running up of the plant without changing the admissible deviation of the actual value from the desired value during normal operation or restricting the control in normal operation.

13 Claims, 1 Drawing Sheet

(56) References Cited

U.S. PATENT DOCUMENTS

| | | | | |
|---|---|---|---|---|
| 6,378,575 | B1 | 4/2002 | Marchau | |
| 2002/0139436 | A1* | 10/2002 | Rosen et al. | 141/86 |
| 2007/0107801 | A1 | 5/2007 | Cochran et al. | |
| 2007/0193652 | A1* | 8/2007 | Till et al. | 141/144 |
| 2008/0243434 | A1* | 10/2008 | Boutin | 702/179 |
| 2010/0005879 | A1* | 1/2010 | Getman | 73/304 C |
| 2010/0023171 | A1* | 1/2010 | Bittner et al. | 700/282 |
| 2010/0241247 | A1* | 9/2010 | Attarwala | 700/21 |

FOREIGN PATENT DOCUMENTS

| | | | |
|---|---|---|---|
| DE | 10149473 | A1 | 4/2003 |
| DE | 102009016806 | A1 | 10/2010 |
| WO | WO-2005108277 | A1 | 11/2005 |
| WO | WO-2007048742 | A1 | 5/2007 |

OTHER PUBLICATIONS

Leslie D. Jensen "The Pitfalls of Alarm Design and Benchmark Analysis", http://www.controlglobal.com/assets/Media/MediaManager/wp_07_001_prosys_alarmmgt.pdf (last accessed Feb. 11, 2015).*

German Search Report for 102010042624.5, dated Aug. 31, 2011.

International Search Report for PCT/EP2011/003366, mailed Oct. 27, 2011.

Written Opinion for PCT/EP2011/003366, mailed Oct. 27, 2011.

International Preliminary Report on Patentability for PCT/EP2011/003366, mailed May 2, 2013.

* cited by examiner

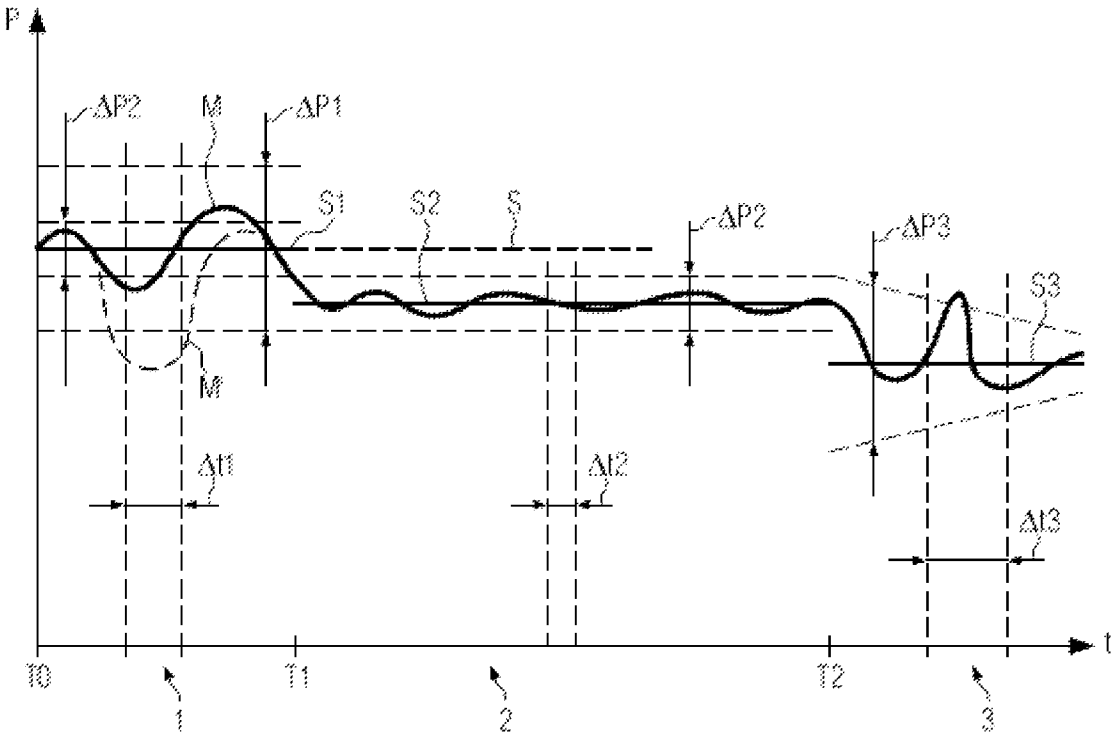
P
t
T0
T1
T2
1
2
3
ΔP1
ΔP2
ΔP2
ΔP3
M
M
S1
S2
S
S3
Δt1
Δt2
Δt3

METHOD OF OPERATING A BOTTLING PLANT

CROSS-REFERENCE TO RELATED APPLICATION

The present application is the United States national phase of International Patent Application No. PCT/EP2011/003366, filed Jul. 6, 2011, which application claims priority of German Application No. 102010042624.5, filed Oct. 19, 2010. The entire text of the priority application is incorporated herein by reference.

FIELD OF THE DISCLOSURE

The present disclosure relates to a method of operating a bottling plant, comprising at least one phase of running up the bottling plant and one phase of normal operation of the run-up bottling plant.

DESCRIPTION OF THE RELATED ART

During the production of beverages and the like in bottling plants, parameters and machine conditions characteristic of a proper operating state are usually constantly monitored. To this end, desired values and admissible deviations from the desired values are determined for the individual parameters, wherein an exceeding of the admissible deviation normally causes a stop of the machine in question. The respective admissible deviations from the desired values here result from the quality demands on the respective product, the filling conditions and the machine construction.

During running production, normally stable production conditions arise, such as constant pressures, uniform flows and constant performance values, for example. These circumstances usually prevent the respective admissible deviations from being exceeded. During running up and shutting down of the plant, however, such stable conditions cannot be always granted. Reasons for instabilities might be, e.g., pressure variations by water hammers during switching on or connecting valves or pumps. Other causes are, for example, the inertia of masses during the acceleration of machine parts or deviations from a predetermined synchronous run of individual drives, caused by their respective control mode.

By such fluctuations, individual parameters can be temporarily deviate from their respective desired values beyond the admissible level. Although no fault must be present in such cases, individual plant parts might nevertheless stop, which in turn may be the cause of further fluctuations of individual parameters and thus can cause further stops. Thus, a concatenation of false positive error messages can occur, whereby the process of running up the bottling plant is unnecessarily retarded and additional interventions by the operator become necessary.

For example, acknowledge switches or the like must be repeatedly actuated in such cases to delete false positive error messages and cause a restart of the respective machine.

Therefore, there is a demand for an improved method of operating a bottling plant, where the above mentioned problems do not occur or only occur in a moderated form.

SUMMARY OF THE DISCLOSURE

The set object is achieved with a method, wherein: the actual value of at least one parameter characteristic of a proper operating state is measured; and in the phase of running up, a deviation of the actual value from a desired value of the parameter other than the deviation in the phase of normal operation is admitted. By this, an admissible deviation of the actual value from the desired value can be adapted to the instable operational conditions during the running up of the plant without changing the admissible deviation of the actual value from the desired value during normal operation or restricting the control in normal operation.

Preferably, for the phase of running up, a deviation higher in terms of amount is admitted than for the phase of normal operation. By a wider admissible fluctuation range of the actual value, it can be prevented that the at least temporarily increased fluctuations of individual parameters compared to normal operation lead to a false positive error message. Consequently, an unnecessary standstill of the respective machine can be prevented. The deviation could be defined, for example, as relative value based on the desired value, or as absolute value, or as a range of values with an admissible maximal value and an admissible minimal value.

Preferably, for the phase of running up, a deviation longer in terms of time is admitted than for the phase of normal operation. By this, one can prevent temporary fluctuations of individual parameters from leading to an unfounded switching off of the respective machine. To this end, the parameter could be averaged, for example, over a certain period, and the averaged result of the measurement could be evaluated. However, it would also be possible to admit deviations which are, in terms of their amount, above a given fluctuation range, this exceeding, however, not lasting longer than a given period.

For the phase of running up, a desired value is preferably predetermined which differs from that for the phase of normal operation. By this, one can consider that during the running up of the plant, acceleration phases or filling phases or the like occur which result in increased power consumption or increased flow rates, or the like. Thus, a known dynamic behavior of the bottling plant during running up can be considered without increasing the admissible deviation from the desired value to an undesired degree and thereby affecting the precision of error detection.

In a particularly advantageous embodiment, in the phase of running up, a deviation is admitted which is updated during the running-up on the basis of the measurement of the characteristic parameter and/or the measurement of at least one further parameter characteristic of the proper operating state. By this, the monitoring of the bottling plant can be constantly adapted to changed conditions. Thus, even changes of the operational conditions which can only be predicted within limits can flow into the monitoring of the bottling plant during the running up without affecting the precision of error detection. In particular, false positive results of parameter monitoring can even be reliably prevented in case of non predictable or non-influenceable operational conditions, as, for example, in case of changing environmental conditions.

In another advantageous embodiment, in the phase of running up, a deviation is admitted which is updated during the running up as a function of time, that means depending on time. This is particularly advantageous if essentially known dynamic influences on the operating state must be taken into consideration. For example, various standard programs which are allocated to certain phases of running up can be employed. In these cases, the number of parameters to be measured and evaluated is minimal.

Preferably, a change from the phase of running up to the phase of normal operation is initiated manually. This permits additional monitoring by an operator. By this, one can avoid that an admissible deviation optimized for running up the plant is also employed for normal production operation, and thus that a parameter fluctuation too high for normal operation is not detected.

In another advantageous embodiment, a change from the phase of running up to the phase of normal operation is automatically initiated on the basis of a change of the switching status in the bottling plant, a function of time, or on the basis of the measurement of at least one parameter characteristic of the proper operating state. By this, an optimal point in time for the change from the phase of running up to the phase of normal operation can be found. In this embodiment, too, it can be reliably prevented that an admissible deviation optimized for the running up of the bottling plant is employed for the phase of normal operation.

Preferably, a not proper operating state is determined if the deviation admitted for the phase of running up is exceeded, by then in particular: stopping production; or selectively discharging products which are affected by the not proper operating state from a regular product stream. Thus, a defined operating state can be allocated to the measured parameter at any time. Thus, the bottling plant can be activated and controlled corresponding to the detected operating state. For example, a command for stopping production can be emitted. By this, for example, the manufacture of defective products, or a damage of the bottling plant by operation at a non-suited parameter value can be prevented. By discharging products which are allocated to the not proper operating state, the further processing of defective products can be prevented. Moreover, the respective products can be checked and supplied again to the regular product stream if predetermined quality criteria are met.

In a particularly advantageous embodiment, in the phase of running up, it is in addition checked whether the actual value exceeds a deviation admitted for the phase of normal operation. By this, the exceeding of a predetermined deviation from the desired value can be determined with greater reliability.

If the actual value exceeds the deviation admitted for normal operation and does not exceed the deviation admitted for running up, an extraordinary operating state is preferably determined by then in particular: selectively discharging products which are affected by the extraordinary operating state from a regular product stream; and/or checking the respective products. By this, for example, an operating state can be defined by the presence of an increased probability of the occurrence of a defective product quality compared to the normal condition. It is therefore, for example, possible to discharge the respective products and to check them for faults without having to stop the bottling plant. For example, one can distinguish between a case where only a reduced product quality must be expected, but the probability of a damage to the bottling plant is low. Moreover, the number of required stops when an admissible deviation is exceeded can be reduced to prevent that each stop for itself causes further parameter fluctuations and thus extends the phase of running up in an undesired manner.

Preferably, the parameter is pressure, electrical power, electric resistance, electrical conductivity, velocity, angular velocity, rotational speed, acceleration, weight, concentration, temperature or force. These parameters are particularly suited for checking machine conditions. It would be, for example, possible to simultaneously detect several ones of the mentioned parameters and to compare their actual values with the respective admissible deviations to be able to determine a proper or not proper operating state with greater reliability.

In an advantageous embodiment, the method furthermore comprises a phase of shutting down the bottling plant, wherein in the phase of shutting down, a deviation of the actual value from the desired value of the parameter other than the deviation in the phase of normal operation is admitted. Since also during the shutting down of the bottling plant, higher parameter fluctuations occur than during the normal operation of the bottling plant, by the use of a deviation of the actual value during the shutting down other than that in normal operation, in principle the same advantageous effects can be achieved as they are described with respect to the phase of running up.

In particular, for the phase of shutting down, a deviation higher in terms of amount than the deviation in the phase of normal operation could also be admitted. Equally, a longer deviation would be possible than for the phase of normal operation. The desired value could also be predetermined for the phase of shutting down in the same advantageous manner deviating from the desired value of normal operation. The update of the admissible deviation for the phase of shutting down could also be analogously effected as described for the phase of running up. Equally, the change from the phase of normal operation to the phase of shutting down could be initiated manually or automatically, as is described with respect to the change between the phase of running up and the phase of normal operation. Furthermore, analogous to the phase of running up, also for the phase of shutting down a not proper operating state and, optionally, an extraordinary operating state could be determined. By this, the same advantages with respect to the selective switching off of the bottling plant and the selective discharging of affected products can be achieved.

Preferably, in the phase of shutting down, then a deviation of the actual value from a desired value of the characteristic parameter other than the deviation in the phase of running up is admitted. By this, one can take into account, for example, the circumstance that during shutting down, normally the power consumption of the bottling plant is reduced, or the like. It is thus possible to check the plant particularly selectively and exactly with respect to the occurrence of parameter fluctuations.

BRIEF DESCRIPTION OF THE DRAWING

A preferred embodiment of the present disclosure is represented in the drawing. The single FIGURE shows a schematic diagram with a characteristic plant parameter and the allocated desired values and admissible deviations during the phases of running up, normal operation and shutting down the plant.

DETAILED DESCRIPTION OF THE PREFERRED EMBODIMENT

The FIGURE shows the time history of a desired value S and an actual value M of a parameter P characteristic of the monitoring of a proper operating state of a bottling plant, which parameter could be, for example, electric power consumption, pressure, a flow rate or the like. The representation here is only given to illustrate the method according to the present disclosure and is not restricted to a certain parameter P or a certain curve progression of the desired value S or the actual value M. The actual value M can be an individual measured value of the parameter P as well as a measuring result calculated in a suited manner.

In the FIGURE, by way of example an operation of the bottling plant is represented which starts with a first phase of running up 1 the bottling plant at a point in time T0. At a point in time T1, the operation of the bottling plant changes from the first phase of running up 1 to a second phase of normal operation 2 of the run-up bottling plant. This phase of comparably stable production conditions lasts to a point in time T2 at which the operation of the bottling plant changes to a third phase of shutting down 3 the bottling plant. The change between the operational phases 1 to 3 can be effected manually as well as automatically, in particular also depending on the measured parameter P.

As can be furthermore taken from the FIGURE, a first desired value S1 of the parameter P is allocated to the first phase of running up 1 the bottling plant, to the second phase of normal operation 2, a second desired value S2 of the parameter P is allocated, and to the third phase of shutting down 3, a third desired value S3 of the parameter P is allocated. The desired values S1 to S3 are only given by way of example as different constant values. For example, to the phases 1 to 3 represented in the FIGURE, a common constant desired value S, a desired value variable in time, could be allocated which is indicated in the FIGURE in a dashed line. Equally, the desired values S, S1 to S3 could follow any curve progression during the operation of the bottling plant. Stepped progressions of the desired value S or several desired values S within at least one of the represented phases 1 to 3 would also be conceivable, depending on the operation mode of the individual machines of the bottling plant. The desired values S1 to S3 could also be updated at certain intervals. The distinction between individual desired values S1 to S3 is only given for a better understanding of the described embodiment.

To the represented operating phases 1 to 3, an admissible deviation of the actual value M from the desired values S1 to S3 each is allocated, wherein the admissible deviation in the example is each defined by an admissible fluctuation range ΔP1 to ΔP3 of the actual value M, that means by the admissible range of values of the parameter P, and by a period Δt1, Δt2, Δt3 within which the deviation ΔP1 to ΔP3 in terms of amount are considered or calculated. The admissible fluctuation range ΔP1 to ΔP3 thus corresponds to an admissible exceeding and/or falling below of the allocated desired value S, S1 to S3.

In the example, a not proper operating state is defined by the actual value or the measured value M each having to deviate, at least over the period Δt1, Δt2, Δt3, in terms of amount from the desired value S1 to S3 to a greater extent than the admissible deviation ΔP1 to ΔP3. This would be the case for the first phase of running up 1 of the bottling plant, for example, with the curve section M' indicated in a dashed line. In other words, the progression of the actual value M according to the curve section M' would characterize a not proper operating state which could, for example, trigger a stop of the machine. In contrast, according to the curve progression represented in a solid line, the actual value M varies, in terms of amount, less in the first phase of running up 1 than the admissible deviation ΔP1. Accordingly, the solid curve progression of the actual value M in the first phase of running up 1 would be characteristic of a proper operating state.

For the method according to the present disclosure, the admissible fluctuation range ΔP1 to ΔP3 can be stated, for example, as relative deviation from the desired value S, S1 to S3, and also as absolute deviation or as deviation independent of signs. The in each case admissible exceeding or falling below of at least one of the desired values S, S1 to S3 could also differ from each other. The admissible fluctuation range ΔP1 to ΔP3 from the desired values S, S1 to S3 can, of course, also be given by a range of values between corresponding maximum values and minimum values of the actual value M.

In the second phase of normal operation 2, a smaller fluctuation range ΔP2 is admissible than in the first phase of running up 1. Equally, the corresponding evaluation period Δt2 during which the actual value M must be within the admissible fluctuation range ΔP2 is smaller than the evaluation period Δt1 of the first phase of running up 1. However, it would also be possible to define identical evaluation periods Δt1, Δt2 for the first and the second phases 1, 2. It would equally be conceivable to only define the evaluation periods Δt1, Δt2 of the first and the second phase 1, 2 differently and to admit an identical fluctuation range ΔP1, ΔP2 of the actual value M.

Different evaluation periods Δt1, Δt2 would make sense, for example, if it were known that in the first phase of running up 1, in a proper operating state, a temporary fluctuation of the actual value M occurred which is, in terms of amount, greater than the admissible fluctuation range ΔP1 in phase 1 of running up. In this case, one wants to avoid that this temporary deviation of the actual value M leads to a false positive error message and is allocated to a not proper operating state.

It is decisive in the sense of the invention that the admissible deviation of the actual value M from the desired value S, S1 in the phase of running up 1 differs such that a dynamic behavior of the bottling plant during running up is taken into consideration and nevertheless a reliable error detection in the stable normal operation is possible. For example, the admissible deviation for the phase of running up 1 may differ from the admissible deviation of the phase of normal operation 2 only by different evaluation periods Δt1, Δt2, only by different fluctuation ranges ΔP1, ΔP2, or by a combination of different evaluation periods Δt1, Δt2 and different admissible fluctuation ranges ΔP1, ΔP2. This can also be achieved indirectly by the desired values S1, S2 of the first and the second phase differing and absolute threshold values for the actual value M remaining unchanged or varying only slightly.

With the optional third phase of shutting down 3 the bottling plant, it becomes clear that the actual value M of the parameter P can be greater than the admissible fluctuation range ΔP3 in terms of amount, but that here a not proper operating state must not necessarily be present if the actual value M is shorter than the respective allocated evaluation period, here Δt3, and is beyond the admissible fluctuation range ΔP3.

In the region of the first phase of running up 1 of the bottling plant, in addition the admissible fluctuation range ΔP2 of the second phase of normal operation 2 is represented. It would be possible to compare the actual value M, in addition to the already described evaluation in the phase of running up 1, also with the admissible fluctuation range ΔP2 of the second phase of normal operation 2. For example, an extraordinary operating state could be defined for those cases where the actual value M in the phase of running up 1 remains within the admissible deviation ΔP1, Δt2 of the first phase 1, but not within the admissible deviation ΔP2, Δt2 of the second phase 2.

With the extraordinary operating state, one could thus characterize a state that is less critical compared to the not proper operating state, in which, while the probability of further processing defective products is increased, the risk of a malfunction of the bottling plant itself can still be classified as low. However, a graduated assessment of the operating state could be effected generally. Thus, it could be, for example, sufficient to single out the products allocated to this extraordinary operating state from the regular product stream without having to stop the bottling plant. The singled-out products, for example filled bottles or labeled not yet filled bottles, could then be subjected to a separate procedure step for checking their product quality. By the bottling plant not having to be stopped in this case, it is avoided firstly that the first phase of running up 1 is extended in an undesired way, and secondly that the stopping of the bottling plant itself causes additional parameter fluctuations with the risk of further stops.

It will be understood that several parameters P characteristic of a proper operating state can be simultaneously evaluated in the sense of the invention and the respective results can be compared to each other, for example the accordance of characteristic fluctuations, in particular of points in time of characteristic changes of parameters, such as maximums, minimums, reversal points of measured curves, zero passages and the like. By this, for example the plausibility of an error message or the determination of an extraordinary and/or not proper operating state could be checked in addition.

Moreover, in individual sections of the first phase of running up 1 and/or the third phase of shutting down 3, different parameters P could be evaluated. For example, a certain parameter P for a partial section of the individual phases 1 to 3 could be particularly significant, in another partial section of the same phases 1 to 3, however, it could be particularly afflicted with operational fluctuations which are not caused by a malfunction.

The third phase of shutting down 3 represents, by way of example, that the admissible fluctuation range ΔP3 of the desired value S3 does not have to be constant during one of the represented phases 1 to 3 but can be adapted to any arbitrary pattern. In the example, the admissible fluctuation range ΔP3 continuously and linearly decreases during the third phase of shutting down 3.

Equally, other curve progressions would be conceivable as a function of time t, for example asymptotic curve progressions or curve progressions defined by arbitrary mathematic functions. Equally, the progression of the admissible fluctuation range ΔP1 to ΔP3 could be updated on the basis of a lookup table. For example, an expected progression of the desired values S, S1 to S3, or expected fluctuations of the desired value could be integrated in this table. It would also be conceivable to update the admissible deviation in at least one of the represented phases 1 to 3 on the basis of previously obtained measured data of the characteristic parameter P.

Equally, the admissible deviations could be adapted on the basis of the measurement of other parameters characteristic of the proper operating state. This adaptation can concern the evaluation period Δt1 to Δt3 as well as the admissible fluctuation range ΔP1 to ΔP3. It would thus be possible to dynamically adapt the admissible deviation of the actual value from the desired value S, S1 to S3 to changing operating conditions to increase the precision of the monitoring of the bottling plant and to reduce the occurrence of false positive monitoring results.

The method according to the present disclosure can be employed for bottling plants and related production plants, in particular also for individual treatment stations of these plants, for example in the beverage production industry or in pharmaceutical production. The use in block-wise combined systems is particularly advantageous, for example in machine blocks comprising a blow molding machine, a labeling machine and a filling machine, as well as optional packaging and palletizing machines, since in such complex systems, a high number of individual drive units must be supplied simultaneously and operated synchronously. Here, for example, by the masses to be moved simultaneously, moments of inertia arise which aggravate the synchronization and monitoring of the individual characteristic parameters. Thus, by the method according to the present disclosure, the phase of running up the plant and the phase of shutting down the plant can be controlled in a tailored manner, wherein in particular an increased accuracy of monitoring is possible as well as an improved prevention of false positive interruptions of production.

What is claimed is:

1. A method of operating a bottling plant, comprising at least one phase of running up the bottling plant and one phase of normal operation of the run-up bottling plant, wherein:

an actual value of at least one parameter characteristic of a proper operating state is measured in one or more of a blow molding machine, a labeling machine, a filling machine, a packaging machine or a palletizing machine, and in the phase of running up, a deviation of the actual value from a desired value of the at least one parameter is admitted that is different from a normal operation deviation admitted in the phase of normal operation, and wherein a change from the phase of running up to the phase of normal operation is automatically initiated on the basis of one of a change of a switching state in the bottling plant, a function of time, or the measurement of the at least one parameter characteristic of the proper operating state.

2. The method according to claim 1, wherein for the phase of running up, the deviation is greater in terms of amount than the normal operation deviation that is admitted for the phase of normal operation.

3. The method according to claim 1, wherein for the phase of running up, the deviation is longer in terms of time than the normal operation deviation that is admitted for the phase of normal operation.

4. The method according to claim 1, wherein for the phase of running up, the desired value, which is different from a normal operation desired value is given.

5. The method according to claim 1, wherein in the phase of running up, the deviation is admitted which is updated during the running up on the basis of one or more of the measurement of the parameter or the measurement of at least one further parameter characteristic of the proper operating state.

6. The method according to claim 1, wherein in the phase of running up, the deviation is admitted which is updated during the running up as a function of time.

7. The method according to claim 1, wherein a change from the phase of running up to the phase of normal operation is initiated manually.

8. The method according to claim 1, wherein, when the deviation admissible for the phase of running up is exceeded, a not proper operating state is determined in which either production is stopped or products which are not concerned by the not proper operating state are selectively discharged from a regular product stream.

9. The method according to claim 1, further comprising, in the phase of running up checking whether the actual value exceeds the deviation admitted for the phase of normal operation.

10. The method according to claim 9, wherein the bottling plant, if the actual value exceeds the deviation admissible for the normal operation and does not exceed the deviation admissible for running up, an extraordinary operating state is determined in which at least one of products which are concerned by the extraordinary operating state are selectively discharged from a regular product stream or respective products are checked.

11. The method according to claim 1, wherein the at least one parameter is pressure, electrical power, electric resistance, electrical conductivity, velocity, angular velocity, rotational speed, acceleration, weight, concentration, temperature or force.

12. The method according to claim 1, further comprising a phase of shutting down the bottling plant, wherein in the phase of shutting down, a further deviation of the actual value from a further desired value of the at least one parameter is admitted that is different from the normal operation deviation.

13. The method according to claim 12, wherein in the phase of shutting down, the further deviation of the actual value from the further desired value of the at least one parameter is admitted that is different from the deviation admitted in the phase of running up.

* * * * *